United States Patent [19]

Gamst

[11] 4,134,547

[45] Jan. 16, 1979

[54] JET PIPE

[75] Inventor: Einar Gamst, Oslo, Norway

[73] Assignee: O. Ditlev-Simonsen, Jr., Oslo, Norway

[21] Appl. No.: 750,411

[22] Filed: Dec. 14, 1976

[51] Int. Cl.[2] ..... B05B 7/10

[52] U.S. Cl. ..... 239/404; 239/434.5; 239/589; 417/196

[58] Field of Search ..... 239/403–405, 239/416, 417, 427, 428.5, 434.5, 589; 169/14, 15; 417/151, 171, 183, 194, 196, 197

[56] References Cited

U.S. PATENT DOCUMENTS

| | | | |
|---|---|---|---|
| 136,780 | 3/1873 | Smith | 417/197 X |
| 2,888,191 | 5/1959 | Neumann et al. | 417/183 X |

FOREIGN PATENT DOCUMENTS

| | | | |
|---|---|---|---|
| 476721 | 5/1929 | Fed. Rep. of Germany | 239/403 |
| 900202 | 12/1953 | Fed. Rep. of Germany | 239/434.5 |
| 1036497 | 8/1958 | Fed. Rep. of Germany | 239/434.5 |
| 511213 | 12/1920 | France | 239/417 |
| 606350 | 6/1926 | France | 239/405 |
| 105995 | 2/1965 | Norway | 239/403 |
| 126678 | 6/1973 | Norway | 239/405 |

*Primary Examiner*—Robert W. Saifer
*Assistant Examiner*—Andres Kashnikow
*Attorney, Agent, or Firm*—Wenderoth, Lind & Ponack

[57] ABSTRACT

A water jet nozzle comprises an inlet pipe extending into a converging conical section of an outlet pipe, with a narrow annular opening between the inlet pipe end and the outlet pipe inner wall. The outlet pipe also has a straight section in continuation of the smaller end of the converging conical section followed by a diverging conical section and a substantially straight outlet section. Pressurized air is introduced through the annular opening to surround the central water flow, thereby reducing friction against the outlet pipe wall, the consecutive outlet pipe sections further improving the shape and reach of the ejected water jet.

9 Claims, 2 Drawing Figures

JET PIPE

BACKGROUND OF THE INVENTION

The present invention relates to a jet pipe intended for connection to a hose, for washing or spraying with water having normal main pressure, particularly where a strong, uniform and far-reaching jet is required, but also where in addition it is desirable to be able to adjust the form and range of the jet. By "normal main pressure" is meant the pressure which normally prevails in the main water distribution system, usually 4–8 kg/cm$^2$. However, the use of the jet pipe is not limited to such water pressure. The jet pipe according to the invention is particularly useful for cleaning for instance the tanks and holds of ships, workshop premises and other large rooms or areas, and it is also well adapted for use in fire engine hoses.

Conventional jet pipes for such purposes are essentially formed as a conically converging outlet nozzle, in order to impart a favourable form and outlet velocity to the jet. Such conventional jet pipes can also be provided with adjustable spreading means for varying the form and range of the water jet.

SUMMARY OF THE INVENTION

The object of the present invention is to provide a jet pipe for use with water from the main, in which compressed air can be utilized to produce a stronger and more far-reaching water jet than by conventional jet pipes subject to the same water pressure.

From Norwegian Patent No. 105 995 which describes a spray pipe for concrete, it is known to utilize air to improve the spraying effect of the pipe. The compressed air is introduced through inclined nozzle apertures in an annulus between an inlet tube for concrete and a surrounding conically converging pipe jacket having a straight outlet portion, and through a slit between the inlet tube and the nozzle annulus. However, this spray pipe is in its illustrated and described form quite incapable of producing a uniform and far-reaching water jet, since the supplied air would penetrate into the water flow in the pipe jacket and cause a diffused and fog like water discharge from the spray pipe. Furthermore, there it is known from Norwegian Patent 126 678 a device to facilitate the transport of concrete in pipe lines, in which compressed air is introduced through an annular slit between an interrupted portion of the concrete pipe and the inside wall of a surrounding conically converging jacket. However, the patent does not in any way suggest how this principle may be utilized in connection with water jet pipes.

Thus, the present invention is based upon the principle which is known per se from the field of concrete transport, whereby an inlet pipe extends into a conically converging portion in a surrounding pipe section to form an annular slit opening between the mouth of the inlet pipe and the conical inner wall of the surrounding pipe section. Compressed air is introduced through the slit opening to form a thin friction reducing air film between the water stream and the conical inner wall of the surrounding pipe section or outlet pipe, resulting in an increased speed of motion for the water in the outlet portion of the jet pipe. However, if this principle is utilized alone the discharged water will adopt a diffused nebular form owing to the influence of the compressed air, which form is unsuitable for the above mentioned purposes as previously mentioned.

According to a new and specific feature of the invention the conically converging portion of the pipe section or outlet pipe is followed by an extension comprising a straight portion, a conically diverging portion and a straight or slightly conically converging portion.

Such configuration of the outlet pipe imparts a parallel axial motion to the water particles, which, together with the high outlet velocity caused by the compressed air, provides a uniform, strong and far-reaching jet unattainable by previously known jet pipes working under the same water pressure.

According to a preferred embodiment of the invention the inlet pipe near its mouth is provided with a plurality of intersecting baffles which extend radially in planes inclined to the longitudinal axis of the jet pipe. The baffles impart a syncronized rotation to the water stream and air stream in the outlet pipe, resulting in a further improved jet effect. Further according to the preferred embodiment of the invention the inlet pipe is adjustably arranged in the outlet pipe to enable relative longitudinal displacement therebetween. Thus it is possible to adjust the width of the annular compressed air slit opening, until the optimal jet effect is obtained for the available water and air pressure. Furthermore, as a result of this feature of the invention, the form of the jet may be varied by varying the slit opening.

BREIF DESCRIPTION OF THE DRAWINGS

The above and further objects and features of the invention will appear from the following description of a preferred embodiment of a jet pipe according to the invention, with reference to the accompanying diagrammatic drawings, wherein FIG. 1 is a longitudinal cross section through the jet pipe, and FIG. 2 is a transverse cross section taken along the line A—A of FIG. 1.

DETAILED DESCRIPTION OF THE INVENTION

Figure 1:
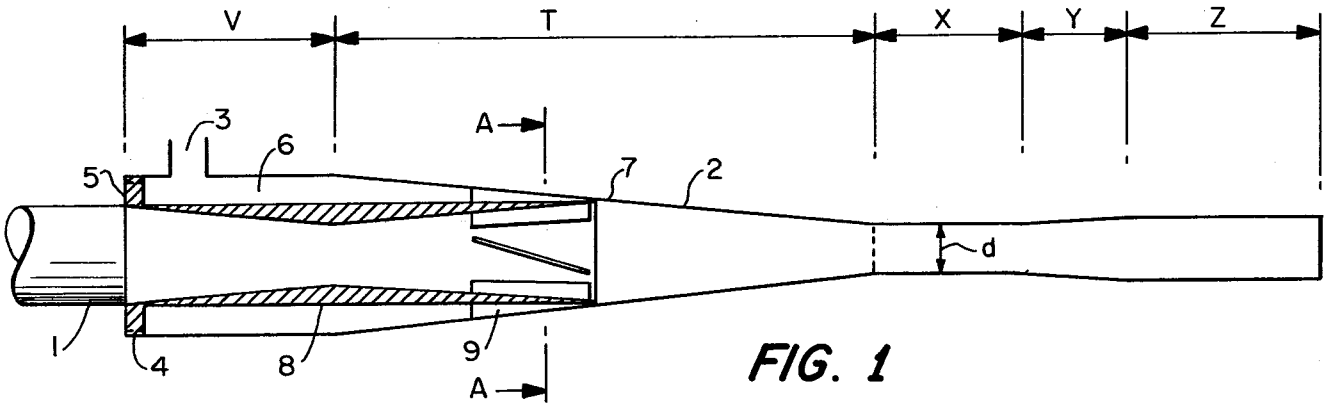
Figure 2:
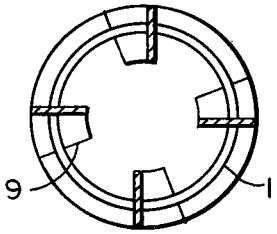

The jet pipe illustrated on the drawings comprises an inlet pipe 1 and an outlet pipe 2. As seen from left to right in the drawing the outlet pipe includes a straight portion V, a conically converging portion T, a straight portion X, a conically diverging portion Y and a terminating straight or slightly converging portion Z. The various portion merge evenly into each other, and the rear straight portion V has an inlet opening 3 for compressed air.

The rear end of the inlet pipe has a conventional fitting (not shown) for connection of a pressurized water supply, e.g. a water hose. Further, an annular, radially extending rear wall 5 is rigidly attached to the outer surface of the inlet pipe 1. The wall 5, and thus the inlet pipe 1 is engaged in the rear end of the outlet pipe 2 by means of screw threads 4. The inlet pipe extends into the conical portion T of the outlet pipe so that an annular chamber 6 is defined between the outer wall and the rear wall of the inlet pipe 1 and the rear part of the outlet pipe 2. At its forward end the chamber 6 terminates in a narrow slit opening 7 between the mouth of the inlet pipe 1 and the conical inner wall of the outlet pipe 2. Because of the screw threads 4 the pipe sections 1 and 2 are relatively displaceable in the longitudinal direction, so that the slit opening 7 can be adjusted from a relatively large opening to a completely closed position in which the mouth of the inlet pipe sealingly engages the conical inner wall of the outlet pipe.

In the conical portion of the chamber 6 compressed air which is introduced through the air inlet 3 will attain a gradually increasing speed toward the slit opening 7, owing to the decreasing cross-section of the chamber. When the slit opening 7 is properly adjusted the compressed air will pass through the slit and form an air film with laminar flow between the water stream from the inlet pipe 1 and the conical inner wall of the outlet pipe, resulting in substantially reduced friction between water and pipe wall and thus in an increased speed for the water stream through the outlet pipe 2. The adjustment of the slit opening 7 is imperative for the motion of the water stream through the outlet pipe; too small an opening will result in an insufficient air film along the pipe wall, while too large an opening will result in disturbing turbulence in the discharging air.

Further according to the invention the inlet pipe 1 may be provided with a plurality, for example four, intersecting baffles 9, which are equally spaced around the mouth thereof and extend radially in planes inclined to the longitudinal axis of the jet pipe. The baffles impart a syncronized rotating component of motion to the water stream and to the air stream in the outlet pipe, which further improve the friction reducing effect of the air film and which contribute to a uniform far-reaching water jet. The outer edge surfaces of the baffles 9 are adapted to the conical shape of the outlet pipe 2, so that they fully engage the latter when the inlet pipe 1 is in its completely threaded-in position.

In order to increase the velocity of the water stream in the inlet pipe 1 the latter is advantageously provided with a venturi nozzle 8.

However, as previously mentioned, the syncronized, rotating air and water stream alone cannot provide an effective uniform and far-reaching water jet, as the form of the jet completely depends upon the special shape of the outlet portions X, Y, Z as described above. In the straight portion X and in the conically diverging portion Y the water particles are further accelerated, and in the straight or slightly conically converging portion Z they are axially joined in a parallel or slightly converging direction of motion, before they leave the orifice of the outlet pipe with high velocity.

Tests have shown that the best results are obtained with a jet pipe in which the relationship between the smallest diameter d of the outlet pipe 2 and the longitudinal dimensions of the respective outlet pipe portions are approximately $X = 3.1$ d, $Y = 2.8$ d and $Z = 3.2$ d respectively. The optimal diverging conicity of the Y-portion is about 5 degrees, while the Z-portion preferably has a converging conicity of between 1 and 2 degrees.

Tests have been performed in which conventional jet pipes have been compared with the jet pipe according to the invention. At a water pressure of 6–7 kg/cm$^2$ a conventional jet pipe for a fire engine hose obtained a maximum jet range of about 30 m, while the working effect ceased at a jet level of about 15 m above the outlet opening. When a jet pipe according to the invention was mounted on the fire engine hose a maximum jet range of 40 m and an effective working level for the water jet up to 25 m was obtained, for a water pressure 6 kg/cm$^2$ and an air pressure of 7 kg/cm$^2$. The amount of water delivered at the effective jet level by the above described water pipe was far above (about 10t/hour above) the amount delivered by the conventional jet pipe, and thus a far stronger water jet with superior washing effect was obtained.

I claim:

1. A jet nozzle for use with fluid under pressure, said jet nozzle comprising:

an outlet pipe having a first conical section which uniformly converges in the direction of the jet;

an inlet pipe extending into said first conical section of said outlet pipe and having an exit portion opening into said outlet pipe, the internal surface of said inlet pipe being provided, near said exit portion thereof, with a plurality of intersecting baffles which extend radially in planes inclined to the longitudinal axis of said inlet pipe;

the smallest diameter of said first conical section being less than the inner diameter of the exit portion of said inlet pipe;

said first conical section of said outlet pipe surrounding at least part of said inlet pipe and defining therewith an annular chamber into which compressed air is introduced;

said annular chamber having a gradually reducing cross-section in the direction of the jet and terminating in a narrow annular opening between the conical inner wall of said first conical secton of said outlet pipe and said exit portion of said inlet pipe; and said outlet pipe also having a straight section forming a continuation of the smaller end of said first conical section, followed by a second conical portion diverging in the direction of said jet, and an outlet secton which is slightly converging in the direction of the jet.

2. A jet nozzle as claimed in claim 1, wherein said inlet pipe is adjustably displaceably mounted in the longitudinal direction relative to said outlet pipe, to permit adjustment of the width of said annular opening.

3. A jet nozzle as claimed in claim 1, wherein the longitudinal dimensions of said straight section, said conically diverging section, and said outlet section of said outlet pipe are approximately 3.1, 2.8 and 3.2 times the smallest diameter of said outlet pipe, respectively.

4. A jet nozzle as claimed in claim 3, wherein the conicity of said conically diverging section of said outlet pipe is approximately 5°, and said outlet section of said outlet pipe has a converging conicity of between 1° and 2°.

5. A jet nozzle as claimed in claim 1, wherein said inlet pipe is provided with a venturi.

6. A jet nozzle for use with fluid under pressure, said jet nozzle comprising:

an outlet pipe having a first conical section which uniformly converges in the direction of the jet;

an inlet pipe extending into said first conical section of said outlet pipe and having an exit portion opening into said outlet pipe;

the smallest diameter of said first conical section being less than the inner diameter of the exit portion of said inlet pipe;

said first conical section of said outlet pipe surrounding at least part of said inlet pipe and defining therewith an annular chamber into which compressed air is introduced;

said annular chamber having a gradually reducing cross-section in the direction of the jet and terminating in a narrow annular opening between the conical inner wall of said first conical section of said outlet pipe and said exit portion of said inlet pipe; and said outlet pipe also having a straight section forming a continuation of the smaller end of said first conical section, followed by a second conical portion diverging in the direction of said jet, and an outlet section which is slightly converging in the direction of the jet, the longitudinal dimensions of said straight section, said conically diverging section, and said outlet section of said outlet pipe being approximately 3.1, 2.8 and 3.2 times the smallest diameter of said outlet pipe, respectively.

7. A jet nozzle as claimed in claim 6, wherein said inlet pipe is adjustably displaceably mounted in the longitudinal direction relative to said outlet pipe, to permit adjustment of the width of said annular opening.

8. A jet nozzle as claimed in claim 6, wherein the conicity of said conically diverging section of said outlet pipe is approximately 5°, and said outlet section of said outlet pipe has a converging conicity of between 1° and 2°.

9. A jet nozzle as claimed in claim 6, wherein said inlet pipe is provided with a venturi.

* * * * *